US009038588B2

(12) United States Patent
Aquino

(10) Patent No.: US 9,038,588 B2
(45) Date of Patent: May 26, 2015

(54) CONTINUOUSLY VARIABLE VALVE LIFT MECHANISM

(71) Applicant: Honda Motor Co., Ltd., Tokyo (JP)

(72) Inventor: Phillip Andrew Aquino, Columbus, OH (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 14/044,908

(22) Filed: Oct. 3, 2013

(65) Prior Publication Data

US 2015/0096512 A1 Apr. 9, 2015

(51) Int. Cl.

| | |
|---|---|
| ***F01L 1/18*** | (2006.01) |
| ***F01L 1/34*** | (2006.01) |
| *F01L 1/04* | (2006.01) |

(52) U.S. Cl.

CPC .... *F01L 1/34* (2013.01); *F01L 1/04* (2013.01); *F01L 1/18* (2013.01)

(58) Field of Classification Search

CPC ..... F01L 1/04; F01L 1/18; F01L 1/34
USPC ..... 123/90.39, 90.44, 90.16
See application file for complete search history.

(56) References Cited

U.S. PATENT DOCUMENTS

| | | | | |
|---|---|---|---|---|
| 7,451,729 | B2 * | 11/2008 | Sugiura et al. | 123/90.16 |
| 7,640,900 | B2 | 1/2010 | Tateno et al. | |
| 7,814,873 | B2 | 10/2010 | Tateno et al. | |
| 7,971,562 | B2 | 7/2011 | Choi et al. | |
| 8,042,501 | B2 | 10/2011 | Kim et al. | |
| 8,061,314 | B2 | 11/2011 | Ezaki | |
| 2011/0036317 | A1 | 2/2011 | Yang et al. | |
| 2011/0197838 | A1 | 8/2011 | Yamaguchi et al. | |

* cited by examiner

*Primary Examiner* — Ching Chang
(74) *Attorney, Agent, or Firm* — Rankin, Hill & Clark LLP

(57) ABSTRACT

A continuously variable valve lift mechanism for an internal combustion engine includes a cam, a cam follower, a valve follower, a rocker shaft, and a rocker arm. The cam follower includes a first roller driven by the cam and a second roller. The valve follower includes a driven face in contact with the second roller of the cam follower and a driving face. The rocker shaft contacts the valve follower. Rotational movement of the rocker shaft about a rocker shaft rotational axis results in movement of the driven face with respect to the second roller. The rocker arm has a pivot axis and is in contact with the driving face of the valve follower.

18 Claims, 3 Drawing Sheets

CONTINUOUSLY VARIABLE VALVE LIFT MECHANISM

The present disclosure is directed to a continuously variable valve lift mechanism for an internal combustion engine.

BACKGROUND

A known valve mechanism for an internal combustion engine uses a rocker arm having a rocker roller to drive a valve. In this conventional valve mechanism, the rocker arm has a bearing section, which contacts a bearing, at a first end and contacts the valve at a second, opposite, end. The rocker roller is positioned between these two ends.

The rocker arm pivots on the bearing. When the rocker roller is pressed, the rocker arm pivots on the bearing pushing the valve in a valve opening direction. When the rocker roller periodically pivots with respect to the bearing, the valve can periodically open and close.

In the conventional valve mechanism described above, a variable valve mechanism can be positioned over the rocker roller. A continuously variable valve lift mechanism is used to continuously vary the intake and exhaust valve lift profile of the valve. This provides a benefit with regard to reducing pumping loss since the valves are already effectively throttling the engine. This allows the throttle body to be left wide open and prevent minimal losses. Known continuously variable valve lift mechanisms require many parts and are rather complicated.

SUMMARY

An example of a continuously variable valve lift mechanism for an internal combustion engine includes a cam, a cam follower, a valve follower, a rocker shaft, and a rocker arm. The cam follower includes a first roller driven by the cam and a second roller. The valve follower includes a driven face in contact with the second roller of the cam follower and a driving face. The rocker shaft contacts the valve follower. Rotational movement of the rocker shaft about a rocker shaft rotational axis results in movement of the driven face with respect to the second roller. The rocker arm has a pivot axis and is in contact with the driving face of the valve follower.

A valve follower for use in a continuously variable valve lift mechanism for an internal combustion engine includes a driving face for contacting a rocker arm and a driven face for contacting a roller of a cam follower. The rocker arm controls the valve lift profile of a valve of the internal combustion engine. The cam follower is driven by a cam. The driven face includes a first section having a first curvature and a second section having a second curvature. The valve follower is configured to rotate about a first axis to change an orientation of the driven face with respect to the roller. The second section is configured such that movement of the roller along the second section results in rotation of the valve follower about a second axis. Greater movement of the driving face about the second axis results from when the roller moves along the second section as compared to when the roller moves along the first section.

Another example of a continuously variable valve lift mechanism for an internal combustion engine includes a cam, a cam follower, a rocker shaft, a valve follower, and a rocker arm. The cam follower includes a first roller driven by the cam and a second roller. The rocker shaft rotates about a rocker shaft rotational axis. The valve follower includes a driven face in contact with the second roller of the cam follower, a driving face and a rocker shaft contact surface in contact with the rocker shaft. Rotational movement of the rocker shaft about the rocker shaft rotational axis results in rotation of the valve follower about the rocker shaft rotational axis changing an orientation of the driven face with respect to the second roller. The driven face includes a first section and a second section. The second section is configured such that movement of the second roller along the second section results in rotation of the valve follower about a valve follower axis, which is offset from the rocker shaft rotational axis. Greater movement of the driving face about the valve follower axis results from when the second roller moves along the second section as compared to when the second roller moves along the first section. The rocker arm contacts the driving face of the valve follower.

DETAILED DESCRIPTION

Figure 1:
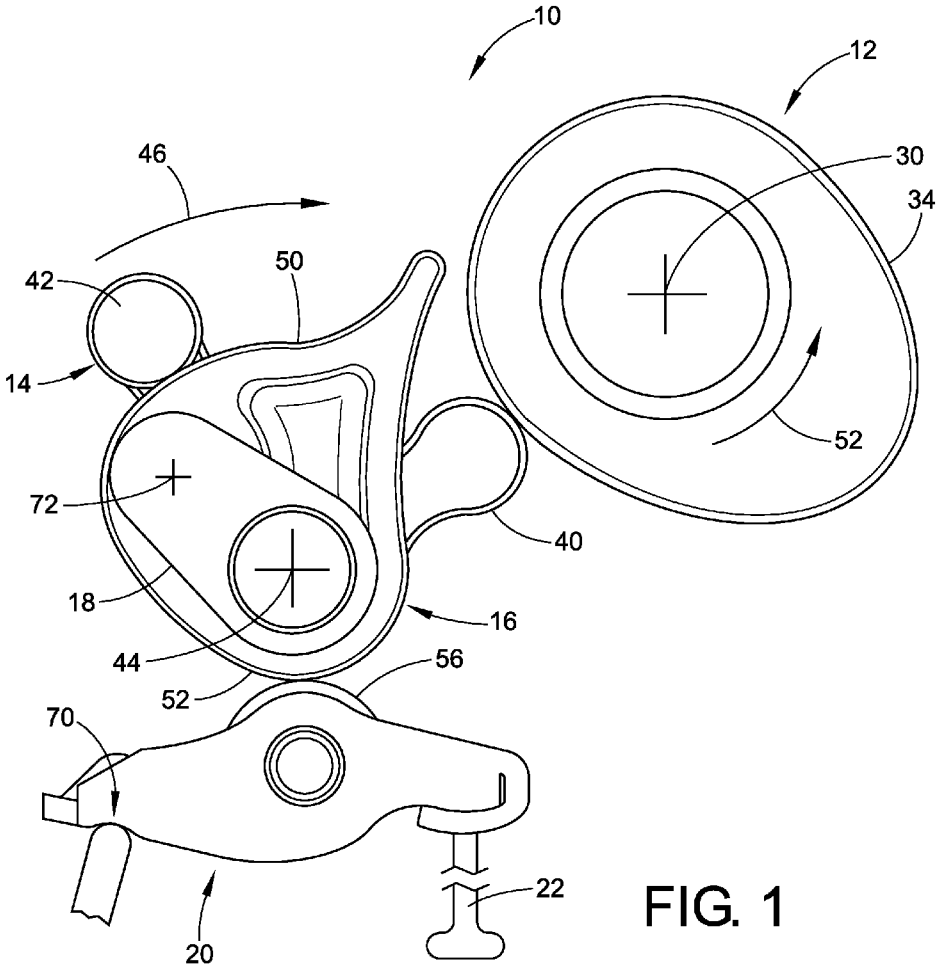
FIG. 1 depicts a continuously variable valve lift mechanism.

FIG. 1 depicts a continuously variable valve lift mechanism 10 (hereinafter valve mechanism) including a cam 12, a cam follower 14, a valve follower 16, a rocker shaft 18, and a rocker arm 20. The valve mechanism 10 is used to vary the intake and exhaust valve lift profile of a valve 22 for an internal combustion engine (not shown). The valve mechanism 10 can reduce pumping loss when the valve 22 is effectively throttling the engine, which can allow the throttle body (not shown) to be left wide open and reduce pumping losses.

The cam 12 rotates about a cam rotational axis 30 in a direction indicated by arrow 32. The cam 12 includes a profile surface 34 that is in contact with the cam follower 14. Rotation of the cam 12 about the rotational axis 30 drives the cam follower 14.

The cam follower 14 is generally L-shaped in configuration. The cam follower 14 includes a first roller 40 and a second roller 42. The first roller 40 contacts the profile surface 34 of the cam 12 and is driven by the cam 12. The cam follower 14 includes an opening (not visible) that receives an axle or shaft (not visible). The cam follower 14 rotates about a cam follower rotational axis 44 in a direction indicated by arrow 46 when driven by the cam 12. The second roller 42 contacts the valve follower 16 and moves along driving the valve follower 16 in a manner that will be described in more detail below. Rotation of the cam follower 14 results in movement of the second roller 42 along a constant radius, which emanates from the cam follower rotational axis 44. As such, a point where the second roller 42 contacts the valve follower 16 also follows a constant radius emanating from the cam follower rotational axis 44.

With reference to FIGS. 2A-2C and FIG. 3, the valve follower 16 includes a driven face 50, a driving face 52, and a rocker shaft contact surface 54. The driven face 50 is in contact with the second roller 42 of the cam follower 14. With reference back to FIG. 1, the driving face 52 of the valve follower 16 is in contact with a rocker roller 56 of the rocker arm 20. The rocker shaft contact surface 54 is in contact with the rocker shaft 18.

Figure 3:
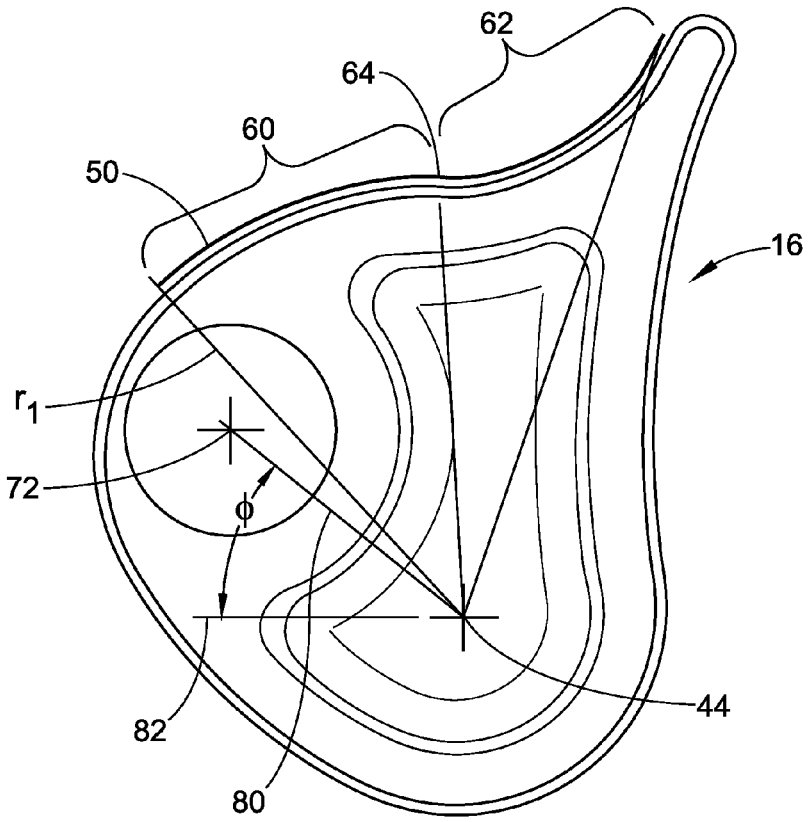
FIG. 3 depicts the valve follower of the continuously variable valve lift mechanism of FIG. 1.

With reference to FIG. 3, the driven face 50 of the valve follower 16 includes a first section 60 and a second section 62.

The first section 60 has a first curvature and the second section 62 has a second curvature. The first section 60 follows a substantially constant radius $r_1$, which is equal to the aforementioned constant radius where the point of the second roller 42 contacts the driven face 50. The second section 62 is curved having an increasing radius, where each of the increasing radii is greater than $r_1$. The first section 60 of the driven face 50 is separated from the second section 62 by a point or line of inflection 64. The substantially constant radius $r_1$ and the increasing radius of the second section 62 each emanate from the cam follower rotational axis 44 about which the cam follower rotates.

The valve follower 16 rotates about two axes. The valve follower rotates about a first axis, which is coincident with the cam follower rotational axis 44 (which is also coincident with a rocker shaft rotational axis), to change an orientation of the driven face 50 of the valve follower 16 with respect to the second roller 42 of the cam follower 14. The valve follower 16 also rotates about a second axis, which will be referred to as a valve follower axis 72, which results in movement of the driving face 52 of the valve follower 16 to drive, or pivot, the rocker arm 20 (FIG. 1).

Figure 2C:
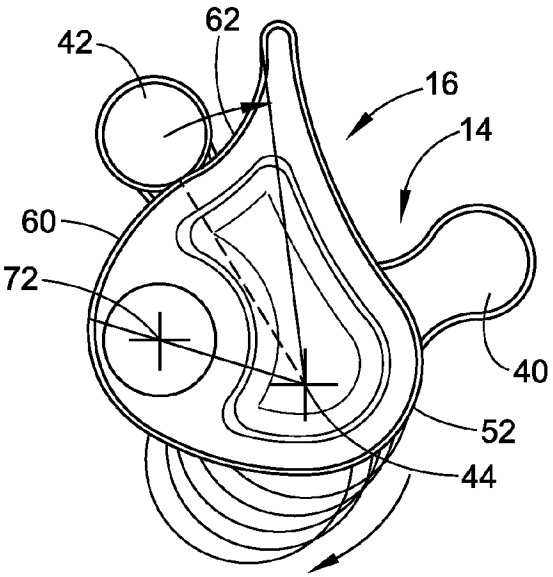
FIGS. 2A-2C depict a valve follower of the continuously variable valve lift mechanism of FIG. 1 in three different positions with respect to a cam follower of the continuously variable valve lift mechanism.
Figure 2B:
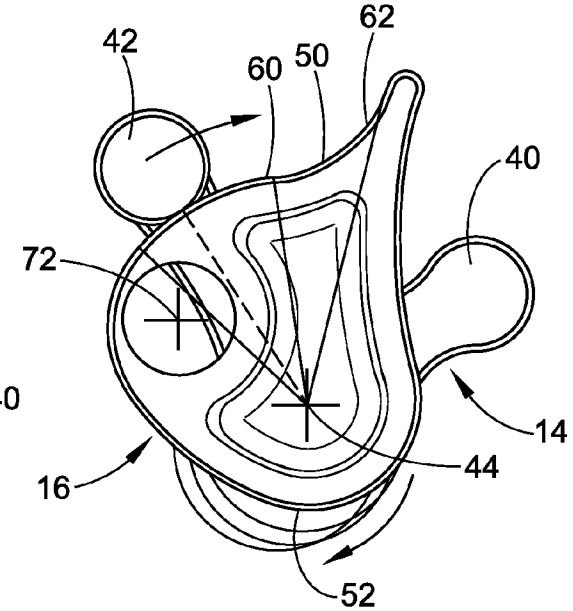
Figure 2A:
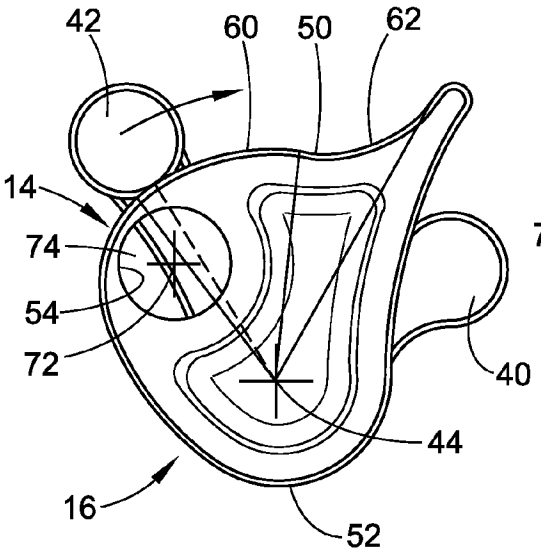

With reference to FIGS. 2A-2C, the second section 62 of the driven face 50 is configured such that movement of the second cam follower roller 42 along the second section 62 results in rotation of the valve follower 16 about the valve follower (second) axis 72. Movement of the second roller 42 along the second section 62 of the driven face 50 also results in greater movement of the driving face 52 about the valve follower (second) axis 72 as compared to when the second cam follower roller 42 moves along the first section 60 of the driven face. In the illustrated embodiment, movement of the second roller 42 along the first section 60 results in no movement of the driving face 52 about the valve follower (second) axis 72. Also, as the second cam follower roller 42 moves along the second section 62 further away from the first section 60, the driving face 52 moves even further about the valve follower axis 72.

Movement of the valve follower (second) axis 72 is accomplished by a force being applied to the rocker shaft contact surface 54 by the rocker shaft 18. As seen in FIGS. 2A-2C, the valve follower 16 includes an opening 74 defined by the rocker shaft contact surface 54 for receiving the rocker shaft 18 (FIG. 1). In the illustrated embodiment, the rocker shaft contact surface 54 is cylindrical and centered with respect to the valve follower (second) axis 72. With reference to FIG. 2A, movement of the second roller 42 of the cam follower 14 along the first section 60 of the driven face 50 results in no movement of the driving face 52 with respect to the pivot axis 70 (FIG. 1) of the rocker arm 20. With reference to FIGS. 2B and 2C, movement of the second roller 42 of the cam follower 14 along the second section 62 of the driven face 50 results in movement of the driving face 52 with respect to the pivot axis 70 (FIG. 1) of the rocker arm 20. The continuously variable valve mechanism 20 can also be designed such that movement of the second roller 40 along the second section 62 of the driven face 50 results in greater movement of the driving face 52 with respect to the pivot axis 70 (FIG. 1) of the rocker arm 20 as compared to when the second roller 42 moves along the first section 60 of the driven face 50.

FIG. 3 depicts an angle $\phi$ which can be adjusted by rotation of the rocker shaft 18 about the rocker shaft rotational axis 44. Adjustment of the angle $\phi$ changes the relationship between wasted cam motion and valve lift, which is depicted in FIGS. 2A-2C. The angle $\phi$ is the internal angle defined between a first line 80 and a second line 82. The first line 80 intersects the valve follower axis 72 and the rocker shaft rotational axis 44, which is also coincident with the cam follower rotational axis. The second line intersects the rocker shaft rotational axis 44, but not the valve follower axis. As illustrated in FIG. 3, the second line 82 is horizontal; however, this is not critical. Adjustment of the angle $\phi$ results in adjustment of valve lift for the valve 22 in contact with the rocker arm 20. As the angle $\phi$ is depicted in FIG. 3, a small angle $\phi$ results in a low maximum lift and a large angle $\phi$ results in high maximum lift. The adjustment of angle $\phi$ is allowable because the driving face 52 and the first section 60 of the driven face 50 are concentric with the rocker shaft rotational axis 44, which is coincident with the cam follower rotational axis.

The orientation of the valve follower 16 is controlled by contact at three points or areas. The valve follower 16 receives an input force from the second roller 42 of the cam follower 14 on the driven face 50. The valve follower 16 receives a hinging force from the rocker shaft 18 at the valve follower axis 72. The valve follower 16 also receives an output force from the rocker arm roller 56 on the driving face 52. Since there is always three points or locations of contact, no lost motion spring is required to control the orientation or position of the valve follower 16, which reduces the complexity of the valve mechanism 10.

Relative position change of the second roller 42 of the cam follower 14, which is rotating about the cam follower rotational axis 44 and is in contact with the driven face 50, causes rotation of the valve follower 16 about the valve follower axis 72 where the radius of the driven face 50 increases from $r_1$. In the illustrated embodiment, the first section 60 of the driven face 50 can be referred to as a constant radius section and when the second roller 42 is in contact with the first section 60, no lift of the valve 22 results. However, when the second roller 42 of the cam follower 14 moves from the first section 60 to the second section 62 (crosses the point of inflection 64) of the driven face 50, increasing lift of the valve 22 results. Also, as the second roller 42 moves along the second section 62 further away from the first section 60, the lift of the valve 22 further increases.

With reference back to FIG. 1, the rocker shaft 18 is in contact with the valve follower 16. Rotational movement of the rocker shaft 18 about the rocker shaft rotational axis 44 results in movement of the driven face 50 with respect to the second roller 42 of the cam follower 14. The rocker shaft 18 includes a protuberance or axle (not visible) that is received in the opening 74 of the valve follower 16. The protuberance or axle contacts the rocker shaft contact surface 54 such that rotation of the rocker shaft 18 results in a change in orientation of the valve follower 16. Movement of the rocker shaft 18 is controlled by an external driver (not shown).

A continuously variable valve lift mechanism has been described above with particularity. Modifications and alternations will occur to those upon reading and understanding the preceding detailed description. The invention, however, is not limited to only the embodiments described above. It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A valve mechanism for an internal combustion engine comprising:

a cam;

a cam follower including a first roller driven by the cam and a second roller;

a valve follower including a driven face in contact with the second roller of the cam follower and a driving face;

a rocker shaft in contact with the valve follower, wherein rotational movement of the rocker shaft about a rocker shaft rotational axis results in movement of the driven face with respect to the second roller; and a rocker arm having a pivot axis and in contact with the driving face of the valve follower;

wherein the driven face includes a first section and a second section, wherein the first section is curved in a convex-shape relative to the rocker shaft rotational axis and follows a substantially constant radius and the second section is curved in a concave-shape relative to the rocker shaft rotational axis and has an increasing radius.

2. The valve mechanism of claim 1, wherein movement of the second roller along the first section results in no movement of the driving face with respect to the pivot axis of the rocker arm and movement of the second roller along the second section results in movement of the driving face with respect to the pivot axis of the rocker arm.

3. The valve mechanism of claim 1, wherein movement of the second roller along the second section of the driven face results in greater movement of the driving face with respect to the pivot axis of the rocker arm as compared to when the second roller moves along the first section of the driven face.

4. The valve mechanism of claim 1, wherein the first section is separated from the second section by a point or line of inflection.

5. The valve mechanism of claim 1, wherein the substantially constant radius and the increasing radius each emanate from a cam follower rotational axis about which the cam follower rotates.

6. The valve mechanism of claim 5, wherein rocker shaft rotational axis is coaxial with the cam follower rotational axis.

7. The valve mechanism of claim 1, wherein the valve follower is configured to rotate about a valve follower axis, which is offset from rocker shaft rotational axis.

8. The valve mechanism of claim 7, wherein an angle defined between a first line, which intersects the valve follower axis and the rocker shaft rotational axis, and a second line, which intersects the rocker axis but not the valve follower axis, is adjustable by rotation of the rocker shaft about the rocker shaft rotational axis.

9. The valve mechanism of claim 8, wherein adjustment of the angle results in adjustment of valve lift for an associated valve in contact with the rocker arm.

10. The valve mechanism of claim 8, wherein an increase of the angle results in greater valve lift for the associated valve in contact with the rocker arm.

11. A valve follower for use in a valve mechanism for an internal combustion engine, the valve follower comprising:

a driving face for contacting a rocker arm, which is in contact with a valve; and a driven face for contacting a roller of a cam follower, which is driven by a cam, the driven face including a first section having a first curvature and a second section having a second curvature, wherein the valve follower is configured to rotate about a first axis to change an orientation of the driven face with respect to the roller, wherein the second section is configured such that movement of the roller along the second section results in rotation of the valve follower about a second axis and greater movement of the driving face about the second axis results from when the roller moves along the second section as compared to when the roller moves along the first section, wherein the valve follower includes a rocker shaft contact surface for contacting a rocker shaft of the valve mechanism, wherein the valve follower includes an opening defined by the rocker shaft contact surface for receiving the rocker shaft.

12. The valve follower of claim 11, wherein the first section follows a substantially constant radius and the second section is curved having an increasing radius.

13. The valve mechanism of claim 11, wherein the first section is separated from the second section by a point or line of inflection.

14. The valve mechanism of claim 11, wherein movement of the second axis is accomplished by a force being applied to the rocker shaft contact surface by the rocker shaft.

15. The valve mechanism of claim 14, wherein the rocker shaft contact surface is cylindrical and centered with respect to the second axis.

16. A valve mechanism for an internal combustion engine comprising:

a cam;

a cam follower including a first roller driven by the cam and a second roller;

a rocker shaft rotatable about a rocker shaft rotational axis;

a valve follower including a driven face in contact with the second roller of the cam follower, a driving face and a rocker shaft contact surface in contact with the rocker shaft, wherein rotational movement of the rocker shaft about the rocker shaft rotational axis results in rotation of the valve follower about the rocker shaft rotational axis changing an orientation of the driven face with respect to the second roller, wherein the driven face includes a first section and a second section, wherein the second section is configured such that movement of the second roller along the second section results in rotation of the valve follower about a valve follower axis, which is offset from the rocker shaft rotational axis, and greater movement of the driving face about the valve follower axis results from when the second roller moves along the second section as compared to when the second roller moves along the first section; and a rocker arm in contact with the driving face of the valve follower.

17. The valve mechanism of claim 16, wherein movement of the second roller along the first section of the driven face results in no movement of the driving face with respect to the valve follower axis.

18. The valve mechanism of claim 16, wherein the first section of the driven face follows a substantially constant radius emanating from a cam follower rotational axis.

* * * * *